US006202221B1

(12) United States Patent
Ackley, Jr.

(10) Patent No.: US 6,202,221 B1
(45) Date of Patent: Mar. 20, 2001

(54) FLEXIBLE SUPPORT STAY

(75) Inventor: George W. Ackley, Jr., Cortland, NY (US)

(73) Assignee: Higgins Supply Company, Inc., McGraw, NY (US)

( * ) Notice: Subject to any disclaimer, the term of this patent is extended or adjusted under 35 U.S.C. 154(b) by 0 days.

(21) Appl. No.: 09/464,494

(22) Filed: Dec. 15, 1999

(51) Int. Cl.[7] ..... A41D 27/00
(52) U.S. Cl. ..... 2/256; 2/255; 2/257; 2/258
(58) Field of Search ..... 2/255, 256, 257, 2/258, 259, 260, 260.01, 261

(56) References Cited

U.S. PATENT DOCUMENTS 1,207,104 * 12/1916 Wallace ..... 2/255
2,666,202 1/1954 Ongley .
2,830,300 4/1958 Schwartz .
3,030,633 4/1962 Chalfin .
3,394,410 * 7/1968 Liebowitz ..... 2/255
3,531,807 10/1970 Devito et al. .
4,777,668 * 10/1988 Weston ..... 2/257

* cited by examiner

*Primary Examiner*—John J. Calvert
*Assistant Examiner*—Gary L. Welch
(74) *Attorney, Agent, or Firm*—Harter, Secrest & Emery LLP; Stephen B. Salai, Esq.; Brian B. Shaw, Esq.

(57) ABSTRACT

A flexible and protective support stay is disclosed. The support stay has insert tabs with rounded edges at both ends to reduce snags when inserting the stay into a garment. The flexibility of the stay is provided by a sinuous member that is independently flexible in two directions. This design enables the stay to flex and move with the wearer of the garment. Because the stay is made as an integrally formed plastic article, the probability that the device will shear and expose the wearer to sharp edges is significantly reduced.

24 Claims, 2 Drawing Sheets

SECTION A–A

SECTION B–B

FLEXIBLE SUPPORT STAY

BACKGROUND OF THE INVENTION

1. Field of the Invention

The present invention relates generally to support stays for use in articles of clothing, and particularly to protective support stays that will flex with the wearers movement without twisting or roll.

2. Technical Background

Support stays are used in ladies undergarments, such as brassieres and corsets, sports garments, orthopedic soft garments and other garments requiring support and anti-roll devices.

One approach that has been considered involves a stay formed of recurring loops of heat treated wire that are fitted with metal caps on the ends. One drawback to this approach involves exposing the wearer to sharp edges produced when the metal caps are separated from the wire. Both the metal caps and the wire have sharp edges. In addition, the edges of the metal caps are prone to catching the fabric during the insertion of the stay within the garment.

In another approach that has been considered, the metal caps are replaced by plastic terminals which are molded onto the wire. While this represents an improvement over the prior art, this approach also has several drawbacks. After repeated usage, the wire has a tendency to corrode and break, exposing the wearer to sharp edges. The recurring wire stay also has the undesirable tendency of completely turning within the pocket of the garment.

In another approach that has been considered, a stay is formed by an injection molding process. The stay includes a thick central strip flanked by a thin edging that has rounded notches. This approach also has a drawback. It is relatively inflexible in that it is incapable of movement in two orthogonol axes. Thus, the stay is characterized by undesirable twisting. In addition, the stay has very little give under a compression force. Hence, the stay is prone to a phenomenon known as "poke-through," to those skilled in the art.

In yet another approach, a stay is formed from a plastic strip having triangular notches that form a zig-zag pattern. While this stay has more flexibility than the stay discussed immediately above, it too is prone to twisting. Further, the end portion of the stay and the notches are formed with sharp angular edges that tend to catch on the fabric during insertion in the garment.

Thus, a need exists for a support stay that is protective and highly snag resistant. A need also exists for a support stay that will flex with the wearers movement on two axes, bending on the flat side as well as on the edge without twisting.

SUMMARY OF THE INVENTION

Existing problems with support stays are solved by the present invention. The flexible support stay of the present invention protects the wearer from sharp edges. It is snag-resistant, using rounded edges to facilitate insertion into the garment. The stay includes a sinuous member that allows the stay to flex with the wearers movement on two axes. The stay is manufactured using an injection molding process and can be produced in several lengths and widths.

One aspect of the present invention is a support stay for an article of clothing. The support stay has a centerline extending in a longitudinal direction and includes: a first insert tab having a first rounded end portion for reducing a coefficient of friction between the support stay and the article of clothing; a sinuous member connected to the first insert tab, the sinuous member formed by alternating a plurality of crests with a plurality of troughs, each of the plurality of crests forming a first acute angle with a first rounded vertex situated on a first side of the centerline, and each of the plurality of troughs forming a second acute angle with a second rounded vertex situated on a second side of the centerline; and a second insert tab connected to the sinuous member, wherein the second insert tab includes a second rounded end portion for reducing the coefficient of friction between the support stay and the article of clothing.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed: The accompanying drawings are included to provide a further understanding of the invention, and are incorporated in and constitute a part of this specification. The drawings illustrate various embodiments of the invention, and together with the description serve to explain the principles and operation of the invention.

DETAILED DESCRIPTION OF THE PREFERRED EMBODIMENTS

Figure 1:
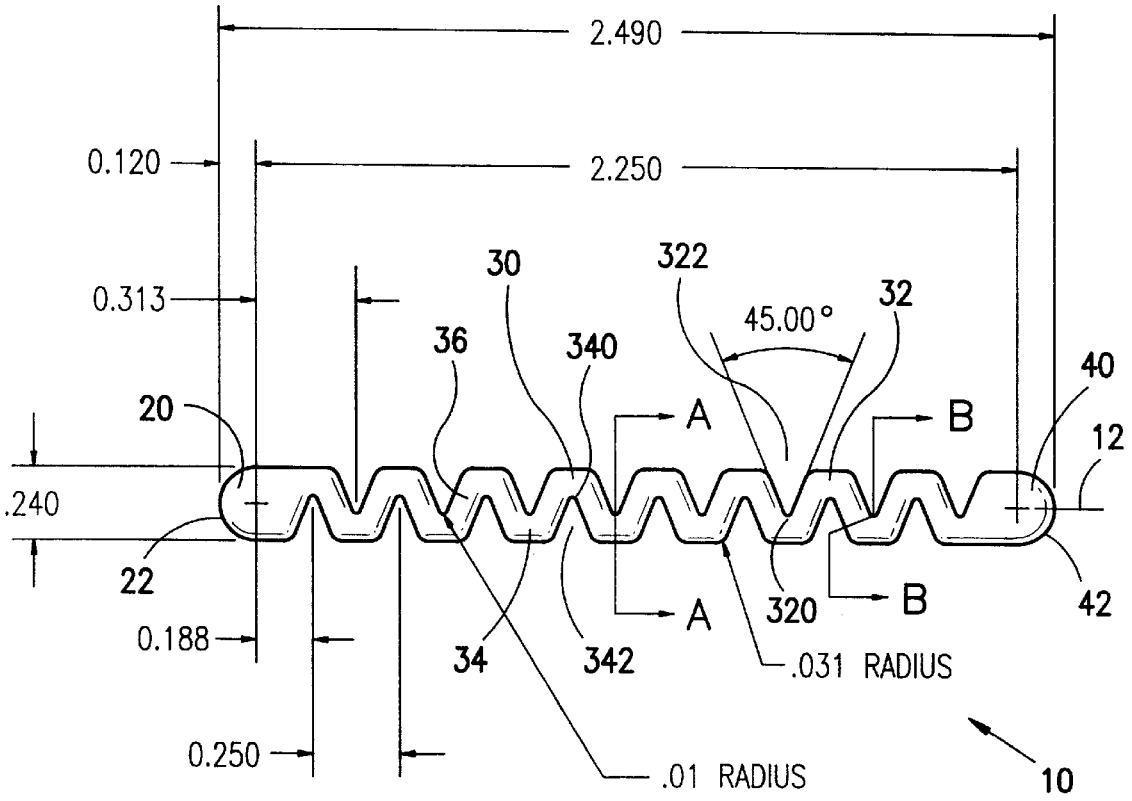
FIG. 1 is a plan view of the flexible stay according to the present invention.

Reference will now be made in detail to the present preferred embodiments of the invention, examples of which are illustrated in the accompanying drawings. Wherever possible, the same reference numbers will be used throughout the drawings to refer to the same or like parts. An exemplary embodiment of the flexible support stay of the present invention is shown in FIG. 1, and is designated generally throughout by reference numeral 10.

In accordance with the invention, the present invention for a flexible support stay includes a sinuous member that includes alternating crests and troughs that allows the stay to flex with the wearers movement on two axes. The support stay includes rounded edges that protect the wearer from poke-through, and snag-resistant to facilitate insertion into the garment.

As embodied herein, and depicted in FIG. 1, support stay 10 includes insert tab 20 and insert tab 40 which are connected to sinuous member 30 at either end of stay 10. Insert tab 20 includes rounded end 22 which is designed to reduce the coefficient of friction between support stay 10 and clothing fabric. Insert tab 40 includes rounded end 42 which is also designed to reduce the coefficient of friction between support stay 10 and clothing fabric.

Sinuous member 30 is formed by alternating crests 32 with troughs 34. Crests 32 are separated by acute angles 322. Each acute angle 322 has a rounded vertex 320 situated below the longitudinal axis 12. Troughs 34 are also separated by acute angles 342. Each acute angle 342 has a rounded vertex 340 situated above the longitudinal axis 12. By providing vertices 320 and 340 below and above longitudinal axis 12, respectively, support stay 10 is independently flexible in two directions orthogonal to longitudinal axis 12, as will be discussed below. Crests 32 are connected to troughs 34 by lateral members 36.

Support stay 10 may be of any suitable well known material, but there is shown by way of example an integrally formed plastic support stay 10 fabricated by an injection molding process. A mold is provided wherein molten plastic is injected into a mold cavity under heat and pressure to form stay 10. One of ordinary skill in the art will recognize that stay 10 can be formed in a variety of shapes and sizes using the injection molding process described herein.

It will be apparent to those of ordinary skill in the pertinent art that modifications and variations can be made to the fabrication process described above depending on the material. For example, other non-conductive, non-corrosive materials having the properties herein described can be used to fabricate stay 10.

Figure 2:
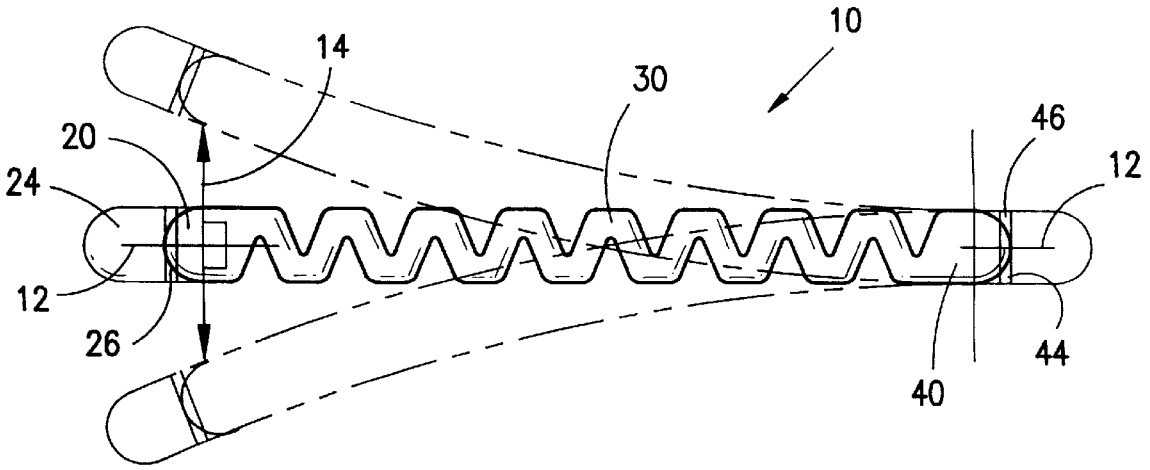
FIG. 2 is a plan view of the flexible stay showing movement in a first orthogonal direction.
Figure 3:
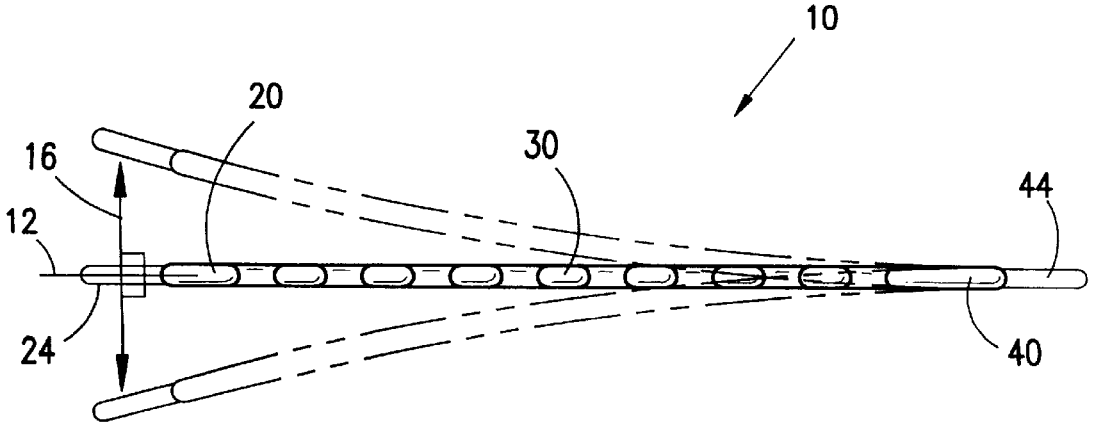
FIG. 3 is a side elevation of the support stay showing movement in a second orthogonal direction.

As embodied herein and depicted in FIG. 2, support stay 10 is flexible in direction 14 orthogonal to axis 12 without linear twisting. One of ordinary skill in the art will recognize that the shape of insert tab 20 may vary depending on the application. In an alternate embodiment, insert tab 20 is replaced with oblong insert tab 24. Oblong tab 24 includes thin protective tip 26 which can be sewn through and permanently attached to a garment. Insert tab 40 is replaced with oblong insert tab 44 and also includes thin protective tip 46. As shown in FIG. 3, support stay 10 is also independently flexible in direction 16 orthogonal to axis 12.

Figure 4:
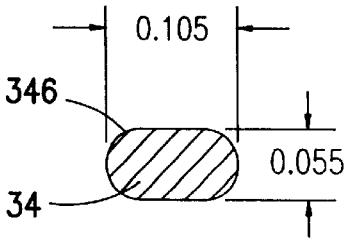
FIG. 4 is a cross-sectional view of the support stay taken through line A—A in FIG. 1.
Figure 5:
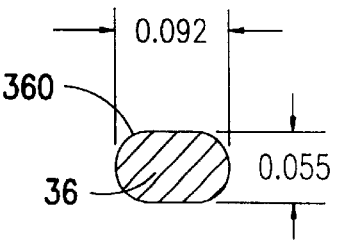
FIG. 5 is a cross-sectional view of the support stay taken through line B—B in FIG. 1.

As embodied herein and depicted in FIG. 4, cross-sectional view A—A shows rounded edge 346 of crest 32 which reduces the coefficient of friction between stay 10 and a clothing fabric. In FIG. 5, cross-sectional view B—B shows rounded edge 360 of lateral member 36.

It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents.

What is claimed is:

1. A support stay for an article of clothing, comprising:

an elongated body having a longitudinal axis, the body having a plurality of crests on a first side of the longitudinal axis separated by acute angles having vertices on the second side of the longitudinal axis and a plurality of troughs on the second side of the longitudinal axis separated by acute angles having vertices on the first side of the longitudinal axis.

2. The support stay of claim 1, wherein each of the plurality of crests and each of the plurality of troughs has a curved shape for reducing the coefficient of friction between the support stay and the article of clothing.

3. The support stay of claim 1, wherein the elongated body is constructed from a resilient material so that it is independently flexible in a first direction orthogonal to the longitudinal direction and a second direction orthogonal to the longitudinal direction.

4. The support stay of claim 1, where each and every acute angle is identical.

5. The support stay of claim 1, further comprising a first insert tab connected to the first end of the elongated body.

6. The support stay of claim 5, further comprising a second insert tab connected to the second end of the elongated body.

7. The support stay of claim 6, wherein the first insert tab and the second insert tab have first and second rounded end portions respectively for reducing a coefficient of friction between the support stay and the article of clothing.

8. The support stay of claim 7, wherein the first insert tab, the elongated body, and the second insert tab are formed from a continuous piece of material.

9. The support stay of claim 7, wherein the support stay is formed of a non-conductive material.

10. The support stay of claim 7, wherein the support stay is formed of a corrosion-resistant material.

11. The support stay of claim 7, wherein the support stay is formed of a plastic material.

12. The support stay of claim 11, wherein the support stay is formed by an injection molding process.

13. The support stay of claim 6, wherein the first insert tab and the second insert tab have an oblong shape.

14. The support stay of claim 13, wherein at least one of the first insert tab and the second insert tab include a thin protective tip for accommodating sewing thread to thereby anchor the support stay to the article of clothing.

15. A support stay for an article of clothing, comprising:

an elongated body having first and second ends, and first and second generally parallel edges, and a longitudinal axis, disposed midway between the edges; and a spaced apart plurality of notches formed along each of the first and second generally parallel edges and extending from one edge past the longitudinal axis towards the other edge.

16. The support stay of claim 15, in which the plurality of notches comprises a plurality of U-shaped notches.

17. The support stay of claim 15, where a width of each of the plurality of notches decreases as the notches approach the longitudinal axis.

18. The support stay of claim 17, in which the plurality of notches comprises a plurality of V-shaped notches.

19. The support stay of claim 17, in which the plurality of Notches comprises a plurality of trapezoid-shaped notches.

20. The support stay of claim 15, further comprising a first insert tab connected to the first end of the elongated body.

21. The support stay of claim 20, further comprising a second insert tab connected to the second end of the elongated body.

22. The support stay of claim 21, wherein the first insert tab, the elongated body, and the second insert tab are formed from a continuous piece of material.

23. The support stay of claim 21, wherein the first insert tab and the second insert tab have an oblong shape.

24. The support stay of claim 15, wherein the elongated body is constructed from a resilient material so that it is independently flexible in a first direction orthogonal to the longitudinal direction and a second direction orthogonal to the longitudinal direction.

* * * * *